US008646519B2

(12) United States Patent
Johanning et al.

(10) Patent No.: US 8,646,519 B2
(45) Date of Patent: Feb. 11, 2014

(54) LOW-PROFILE SUSPENSION OF LOGGING SENSOR AND METHOD

(75) Inventors: Jeff Johanning, Twinsburg, OH (US); Keith David Jones, Twinsburg, OH (US); Clemens Horst, Houston, TX (US)

(73) Assignee: Sondex Wireline Limited, Farnborough, Hampshire (GB)

( * ) Notice: Subject to any disclaimer, the term of this patent is extended or adjusted under 35 U.S.C. 154(b) by 654 days.

(21) Appl. No.: 12/971,584

(22) Filed: Dec. 17, 2010

(65) Prior Publication Data

US 2012/0152518 A1 Jun. 21, 2012

(51) Int. Cl.
*E21B 47/01* (2012.01)

(52) U.S. Cl.
USPC ..... 166/65.1; 29/447; 367/25

(58) Field of Classification Search
USPC ..... 166/65.1; 181/102; 29/447; 367/25, 35, 367/38; 175/50, 325.5
See application file for complete search history.

(56) References Cited

U.S. PATENT DOCUMENTS

| | | | | | |
|---|---|---|---|---|---|
| 3,230,740 | A * | 1/1966 | Fox | 464/18 |
| 3,323,326 | A * | 6/1967 | Vertson | 464/20 |
| 3,503,224 | A * | 3/1970 | Davidescu | 464/20 |
| 3,782,464 | A * | 1/1974 | Quichaud et al. | 166/319 |
| 4,139,994 | A * | 2/1979 | Alther | 464/20 |
| 4,443,206 | A * | 4/1984 | Teng | 464/20 |
| 4,779,852 | A * | 10/1988 | Wassell | 267/125 |
| 4,987,684 | A * | 1/1991 | Andreas et al. | 33/304 |
| 5,613,561 | A * | 3/1997 | Moriarty | 166/387 |
| 6,088,294 | A * | 7/2000 | Leggett et al. | 367/25 |
| 6,364,039 | B1 * | 4/2002 | Majkovic | 175/320 |
| 6,439,055 | B1 * | 8/2002 | Maron et al. | 73/705 |
| 6,749,030 | B2 * | 6/2004 | Blair et al. | 175/45 |
| 6,808,455 | B1 * | 10/2004 | Solorenko et al. | 464/20 |
| 6,868,035 | B2 * | 3/2005 | West | 367/25 |
| 7,252,174 | B2 * | 8/2007 | Cox et al. | 181/111 |
| 7,424,928 | B2 * | 9/2008 | Cox et al. | 181/111 |
| 7,578,360 | B2 * | 8/2009 | Haughom | 175/325.3 |
| 7,984,771 | B2 * | 7/2011 | Pabon et al. | 175/56 |
| 8,364,406 | B2 * | 1/2013 | Gleitman | 702/11 |
| 2002/0181909 | A1 * | 12/2002 | Grunbeck et al. | 385/123 |
| 2005/0092527 | A1 * | 5/2005 | Le et al. | 175/325.6 |
| 2005/0217898 | A1 * | 10/2005 | Clark | 175/56 |
| 2007/0056794 | A1 * | 3/2007 | Cox et al. | 181/111 |
| 2007/0235224 | A1 * | 10/2007 | Koger | 175/40 |
| 2012/0152518 | A1 * | 6/2012 | Johanning et al. | 166/65.1 |
| 2012/0285779 | A1 * | 11/2012 | Samuelson | 188/378 |

* cited by examiner

*Primary Examiner* — Daniel P Stephenson
(74) *Attorney, Agent, or Firm* — Global Patent Operation

(57) ABSTRACT

Presented are systems and methods for dampening vibrations transmitted to a sensor assembly based on well drilling operations. Vibration isolators are distributed around a sensor assembly and retained in their desired location. The sensor assembly and retained vibration isolators are inserted in a shrinkable thin-walled tube and the thin-walled tube is shrunk to constrict the inner surface of the thin-walled tube, and the retained vibration isolators against the outer surface of the sensor assembly. Additionally, the constricted thin-walled tube restrains a wiring harness associated with the sensor assembly in a wire well traversing the axial direction of the sensor assembly.

20 Claims, 8 Drawing Sheets

LOW-PROFILE SUSPENSION OF LOGGING SENSOR AND METHOD

TECHNICAL FIELD

The present invention relates generally to down-hole remotely operated oil well wireline and MWD/LWD (Measure While Drilling/Log While Drilling) tools and, more specifically, to a low-profile vibration-dampening mounting system for suspending logging sensors within a down-hole MWD tool.

BACKGROUND

The ever increasing use of fossil fuels has led to the development of drilling technologies that were unimaginable in the recent past. For instance, the ability to determine the geological strata and the probability of drilling a producing well can be determined from sensing devices placed near the bit head of a well drill. In certain cases the delicate nature of the active element of a sensing device can place requirements on vibration-dampening mounting systems that state of the art technology is unable to meet.

In one example, a gamma radiation detecting sensor is mounted close to the bit head of a well drill. The sensitivity of nuclear logging equipment is directly related to the volume and therefore the diameter of the active sensing element. In the case of a gamma radiation detector, the active sensing element is typically a thallium-doped sodium iodide crystal that is sensitive to mechanical vibration and shock. If the active element receives too much vibration then false readings and a general degradation of the mechanically delicate active element can occur. In extreme cases, if the active element receives too great a shock then mechanical failure of the crystal sensing element can occur.

Obtaining maximum sensitivity of the active element requires that the portion of the sensing element containing the active element be assembled from relatively thin-walled components that do not permit the implementation of typical sensor suspension methods. Current methods of vibration dampening and suspension of logging sensors within cylindrical pressure housings generally rely on a series of large cross-section O-rings installed around the sensor housing along and perpendicular to the axial length of the sensor assembly. In another current method of vibration dampening and logging sensor suspension, a series of metallic leaf springs, extending along the axis of the sensor assembly, are installed between the outer surface of the sensor housing and the inner surface of the pressure housing.

The O-ring suspension method divides the sensor into sections that can be tuned to a high enough resonant frequency to be unaffected by the vibrations of typical operating conditions. The resonant frequency tuning requirement is at odds with the requirement to maximize the sensing element volume and therefore produces active element tube lengths longer than desirable between O-ring supports. In a typical installation, the sensing crystal is positioned at the center of an O-ring to O-ring gap and receives the maximum displacement from the induced vibrations. Consequently, as described above, sensor behavior ranging from false counts to sensing crystal failure can occur. Further, O-ring placement around the outer surface of the sensor assembly can interfere with the passage of the electrical conductors along the axial surface of the sensor assembly.

In the leaf spring suspension method, the leaf springs are fabricated from formed sheetmetal sections. Based on the mechanical properties of the sheetmetal, the stiffness required to produce a sufficiently high resonant frequency consequently produces a greater than desirable insertion/extraction force on the sensor assembly as it is inserted into or extracted from the pressure housing. The mechanical stresses therefore can result in deformation of the sensor assembly or significant shock to the sensor active element. In either case, premature failure of the active sensor element can occur. Further, the assembler should take care when inserting the sensor assembly into the pressure housing to prevent the leaf spring suspension system from damaging the electrical conductors running along the axial surface of the sensor assembly.

Under the above described well sensor operating conditions, a system and associated methods are desired allowing the damping of vibration while permitting the largest possible diameter crystal sensing element and its associated optically matched photomultiplier tube. The system should allow a longer useful life of the active sensing element and reduce the amount of error generated because of excessive vibrations and false counts. The system should provide uninterrupted and uncompromised passage of electrical conductors and permit visible inspection of the electrical harness. The ability for end user assembly and disassembly for sensor element servicing is also desired.

SUMMARY

Systems and methods according to these exemplary embodiment descriptions address the above described needs by providing a series of strips or loops, of a relatively small cross-section, acting as isolators between the outer surface of the sensor assembly and the inner surface of a shrinkable thin-walled tube. After shrinking, the exemplary embodiment thin-walled tube constricts the isolators against the outer surface, holding the isolators in place during insertion into the pressure shell and allowing the isolators to compress against the pressure shell. In a further aspect of the exemplary embodiment, the thin-walled tube encloses and protects the electrical harness, extending along the axial length of sensor assembly, and constrains the electrical harness in a shallow wire well.

According to an exemplary embodiment of a low-profile well sensor suspension system, a series of vibration isolators are used to dampen vibrations generated from well drilling and exerted on the sensor assembly. The exemplary embodiment includes a retainer for attaching the vibration isolators to their desired locations and restraining them in these positions. Further, the exemplary embodiment continues by including a shrinkable thin-walled tube for encasing the vibration isolators and the sensor assembly. After shrinking the included thin-walled tube, the exemplary embodiment constricts the vibration isolators against the outer surface of the sensor assembly.

According to another exemplary embodiment, a method for positioning and retaining a series of vibration isolators between a sensor assembly and a shrinkable thin-walled tube, encasing the vibration isolators and the sensor assembly, is presented. Continuing with the exemplary embodiment method, the series of vibration isolators are positioned around a circumference of an outer surface of the sensor assembly. In the next step of the exemplary embodiment method, the positioned vibration isolators are retained against the outer surface of the sensor assembly. Further in the exemplary embodiment method, the sensor assembly, including the retained vibration isolators, is inserted into a shrinkable thin-walled tube. Continuing with the exemplary embodiment method, shrinking the shrinkable thin-walled tube until the thin-walled tube constricts the vibration isolators against the outer surface of the sensor assembly.

In a further exemplary embodiment, a system for protecting well sensor instrumentation is described. The exemplary embodiment includes a means for dampening vibrations delivered to a sensor assembly based on well drilling operations. The exemplary embodiment further includes a means for retaining a series of vibration isolators associated with dampening the vibrations. Continuing with the exemplary embodiment, included is a means for encasing the vibrations isolators and the sensor assembly.

BRIEF DESCRIPTION OF THE DRAWINGS

The accompanying drawings illustrate exemplary embodiments, wherein.

DETAILED DESCRIPTION

The following detailed description of exemplary embodiments refers to the accompanying drawings. The same reference numbers in different drawings identify the same or similar elements. Also, the following detailed description does not limit the invention. Instead, the scope of the invention is defined by the appended claims.

Figure 1:
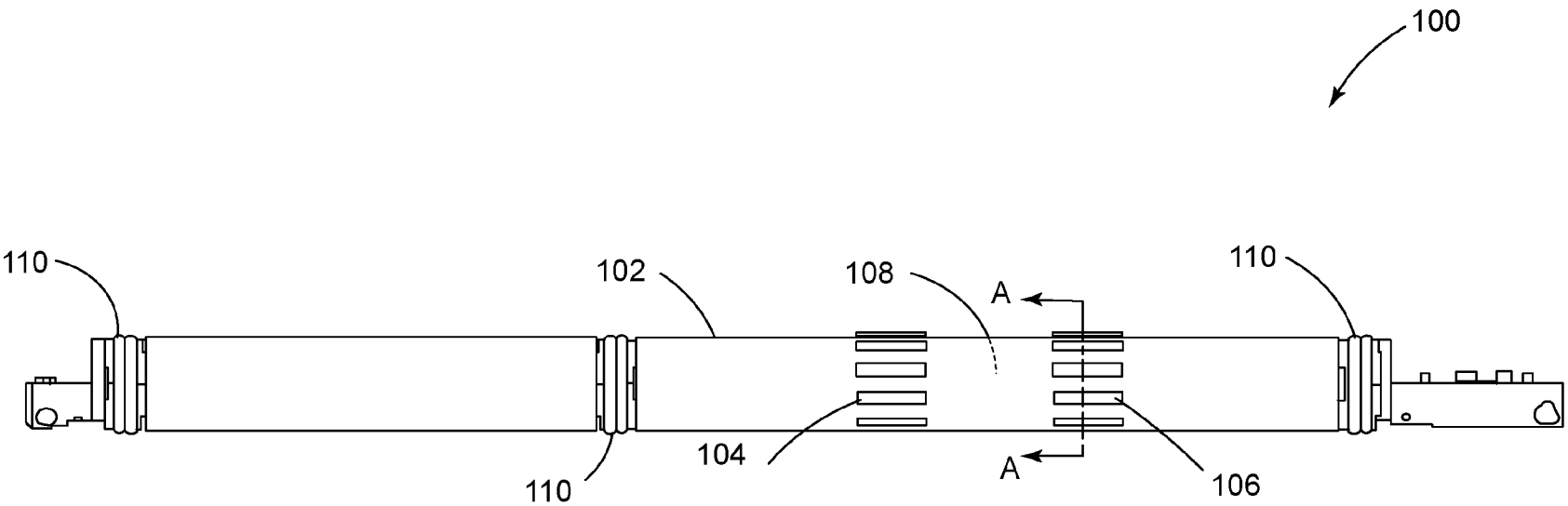
FIG. 1 depicts a sensor low-profile suspension system with a strip (pinstripe) isolator arrangement.

Looking to FIG. 1, a detailed diagram of an exemplary embodiment of a low-profile logging sensor suspension system 100 is presented. The exemplary embodiment includes a sensor assembly 108, a shrinkable thin-walled tube 102, a first plurality of vibration isolators 104 placed around a first circumferential location of the sensor assembly 108 and a second plurality of vibration isolators placed around a second circumferential location of the sensor assembly 108. It should be noted in this exemplary embodiment that the sensor assembly 108 and the vibration isolators 104, 106 are encased in the shrinkable thin-walled tube 102 and the shrinkable thin-walled tube is already constricted. Further, in this exemplary embodiment, it should be noted that the encased sensor assembly is inserted in a pressure housing 718 (see FIG. 7) and the pressure housing 718 (see FIG. 7) is connected to a well drill and lowered into a well as part of the well drilling operation. It should also be noted, as illustrated in this exemplary embodiment, that the low-profile logging suspension system 100 can be used with existing O-ring 110 technology.

In general, this exemplary embodiment depicts two series of vibration isolators 104, 106 placed in locations around two different circumferential positions on the outer surface of the sensor assembly 108. In this exemplary embodiment, the vibration isolators 104, 106 are equally spaced from adjacent vibration isolators 104, 106 in their cross-sectional plane. It should be noted that other exemplary embodiments can have any number of vibration isolators 104, 106 arranged in other locations not equally spaced or symmetrical with respect to the outer surface of the sensor assembly 108 or other vibration isolators 104, 106.

Continuing with the exemplary embodiment, the vibration isolators 104, 106 are cylindrical strips in shape and of a length optimized for vibration reduction based on the number of strips employed and the composition of the strips. A non-limiting example of a material for constructing vibration isolators 104, 106 is a fluoroelastomer.

In another aspect of this exemplary embodiment, after shrinking, the thickness of the thin-walled tube is such that the vibration isolators 104, 106 have a greater thickness than the thin-walled tube and extend above the radial height of the thin-walled tube when compared to a location where the thin-walled tube is constricted directly to the outer surface of the sensor assembly. In this regard, the exemplary embodiment thin-walled tube 102 acts to restrain the vibration isolators 104, 106 and as a smooth surface facilitating insertion of the thin-walled tube 102 encased sensor assembly 108 into a pressure housing 718 (see FIG. 7).

Figure 2:
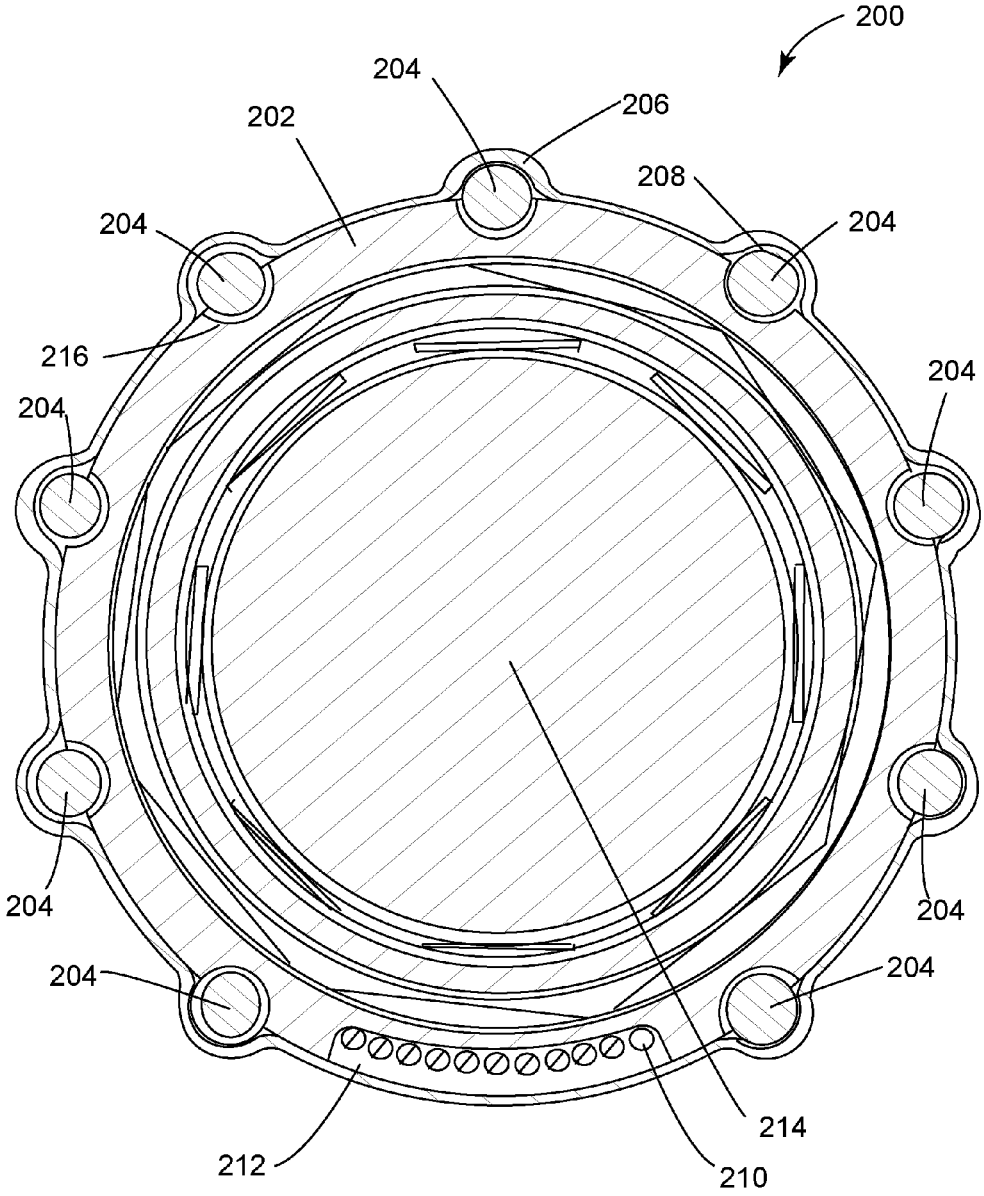
FIG. 2 depicts an enlarged cross-section view of a sensor low-profile suspension system with a pinstripe isolator arrangement.

Looking now to FIG. 2, an exemplary embodiment is depicted of a cross-section 200 of a low-profile logging sensor suspension system 100 (see FIG. 1). The exemplary cross-section 200 is shown from position A-A on the low-profile logging sensor suspension system 100 (see FIG. 1). The exemplary embodiment cross-section 200 includes a sensor assembly 202, a plurality of vibration isolators 204 in isolator channels 216, a shrinkable thin-walled tube 206, a retainer 208, a wiring harness 210 in a wire well 212 and the active element 214 of the sensor assembly 202.

In an exemplary embodiment, the sensor assembly 202 outer surface can have isolator channels 216 made (e.g., cut, stamped, pressed, rolled, etc.) to a depth sufficient to retain the vibration isolators 204 in place when the thin-walled tube 206 encased sensor assembly 202 is inserted or removed from the pressure housing 718 (see FIG. 7) and to allow a vibration isolator of sufficient thickness to dampen operational vibrations to an acceptable level. It should be noted that in other exemplary embodiments the sensor assembly 202 does not have isolator channels 216 made for the vibration isolators 204 and the vibration isolators rest against the outer surface of the sensor assembly 202.

Figure 3:
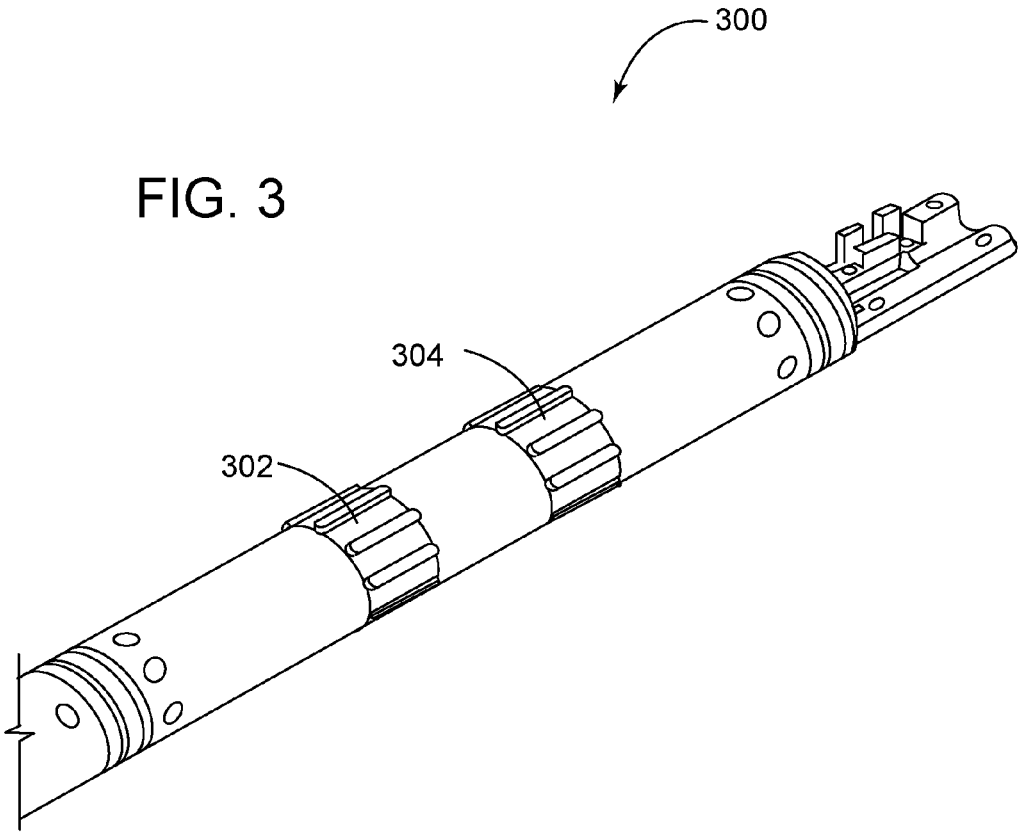
FIG. 3 depicts a sensor low-profile suspension system with a pinstripe isolator arrangement wherein the isolators are taped in position for wrapping.

Continuing with the exemplary embodiment, a retainer 208 can retain the vibration isolators against the sensor assembly 202 until the shrinkable thin-walled tube 206 shrinks around the sensor assembly 202 and attached vibration isolators 204. In this exemplary embodiment, the retainer 208 can be cellophane tape wrapped around the sensor assembly 202 and over the plurality of vibration isolators 204. FIG. 3 depicts an exemplary embodiment 300 of a first band 302 of cellophane tape and a second band 304 of cellophane tape restraining vibration isolators 204 against the sensor assembly 202. It should be noted that in other exemplary embodiments, the retainer 208 can be an epoxy resin applied between the vibration isolators 204 and the sensor assembly 202 or an elastic band wrapping the vibration isolators 204 and the sensor assembly 202.

Returning to FIG. 2, the exemplary embodiment depicts a shrinkable thin-walled tube 206 constricting the vibration isolators 204 against the sensor assembly 202. The cross-section 200 illustrates the shrinkable thin-walled tube 206 after shrinking, however, before shrinking the shrinkable thin walled tube's 206 inner diameter is greater than the diameter of the sensor assembly 202/vibration isolators 204 pair allowing for easy insertion of the sensor assembly 202/vibration isolators 204 pair into the shrinkable thin-walled tube 206. As described previously, the shrinkable thin-walled tube 206 can restrain the vibration isolators 204 from movement during insertion into or removal from the pressure housing 718 (see FIG. 7) and can provide a smooth seamless surface for reducing the force required to insert or remove the sensor assembly 202/vibration isolators 204 pair from the pressure housing 718 (see FIG. 7).

In a non-limiting exemplary embodiment, a shrinkable thin-walled tube 206 can be manufactured from polytetrafluoroethylene. It should be noted that in other exemplary embodiments, the shrinkable thin-walled tube 206 can be manufactured from an aromatic polyamide. Further, in another exemplary embodiment, the vibration isolators 204 can be attached to the inner surface of the shrinkable thin-walled tube 206 and secured to the outer surface of the sensor assembly 202 by the constrictive forces generated by shrinking the shrinkable thin-walled tube 206 around the sensor assembly 202.

Continuing with the exemplary embodiment, a wiring harness 210 can reside in a wire channel 212 and restrained by the retainer 208 and the shrinkable thin-walled tube 206. In this exemplary embodiment, the wiring harness is protected from cutting or chafing because the wiring harness 210 cannot escape from its protective covered wire channel 212 and become pinched between the outer surface of the sensor assembly and the inner surface of the pressure housing 718 (see FIG. 7) during insertion into or removal from the pressure housing 718 (see FIG. 7) of the sensor assembly 202. It should be noted in this exemplary embodiment that the vibration isolators 204 and the shrinkable thin-walled tube can be replaced as required during periodic field inspection and service.

Figure 4:
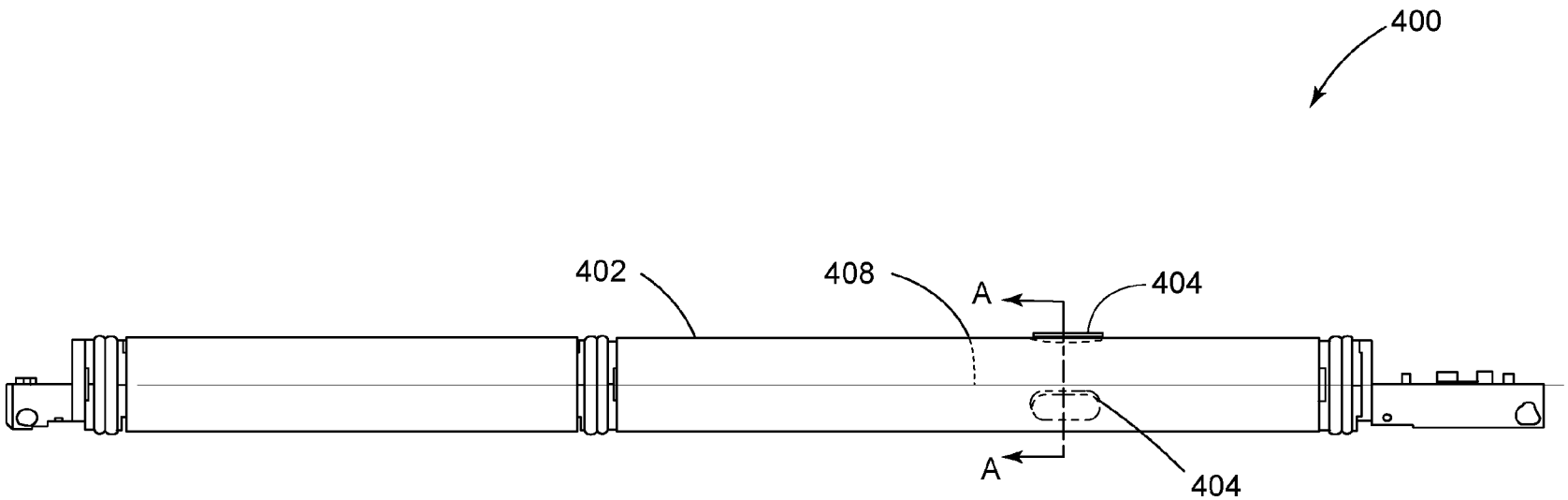
FIG. 4 depicts a sensor low-profile suspension system with an oval (racetrack) isolator arrangement.

Continuing now to FIG. 4, a detailed diagram of an exemplary embodiment of a low-profile logging sensor suspension system 400 is presented. The exemplary embodiment includes a sensor assembly 408, a shrinkable thin-walled tube 402 and a plurality of vibration isolators 404 placed around a circumferential location of the sensor assembly 408. It should be noted in this exemplary embodiment that the sensor assembly 408 and the vibration isolators 404 are encased in a shrinkable thin-walled tube 402 and the shrinkable thin-walled tube is already constricted. Continuing with the exemplary embodiment, the vibration isolators 404 can be oval in shape and can be of sufficient number to provide the amount of dampening required by the active element of the associated sensor assembly 408 or by other conditions associated with the well drilling operations.

Figure 5:
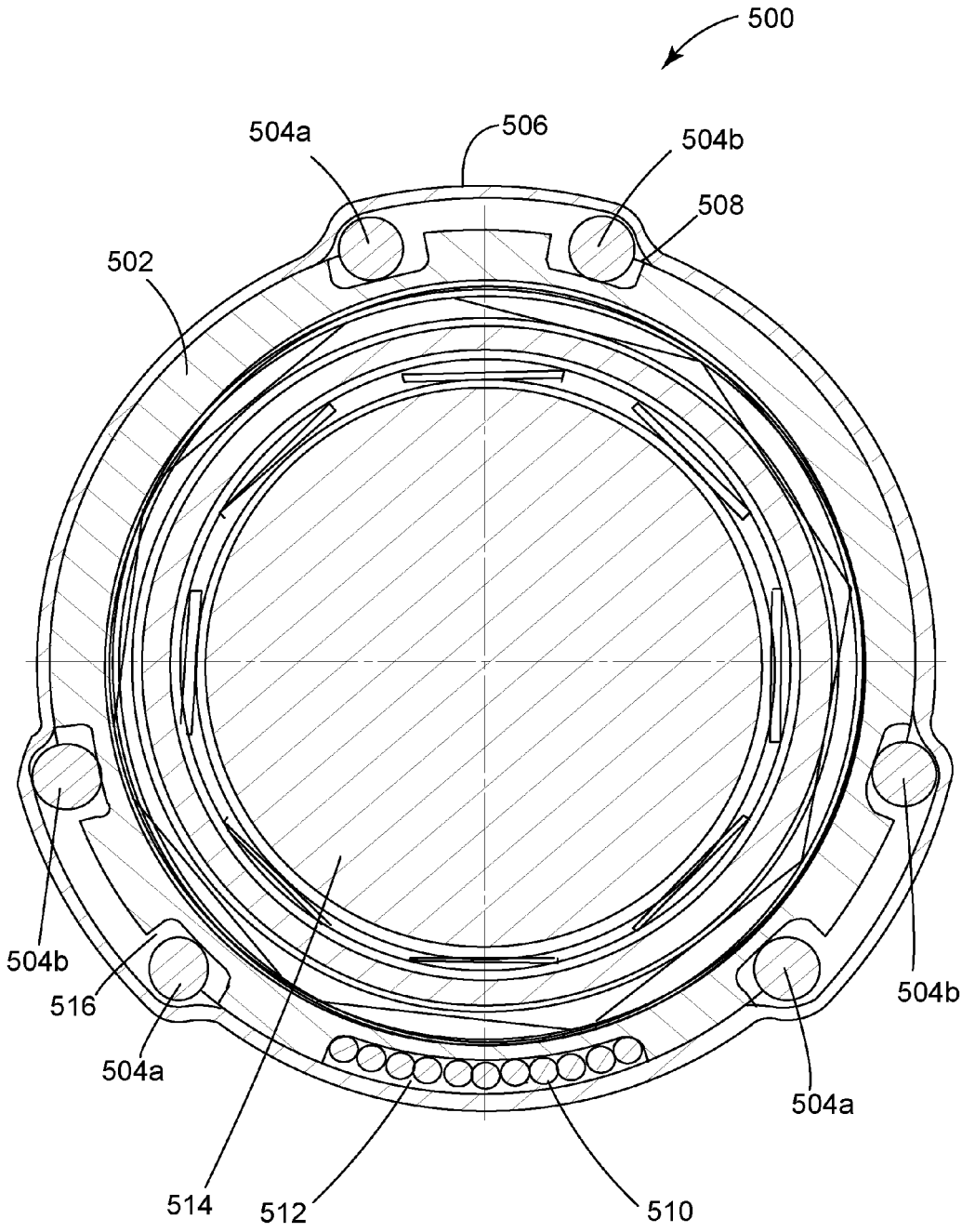
FIG. 5 depicts an enlarged cross-section view of a sensor low-profile suspension system with a racetrack isolator arrangement.

Looking now to FIG. 5, an exemplary embodiment of a cross-section 500 of a low-profile logging sensor suspension system 500 is depicted. The exemplary cross-section 500 is shown from position A-A on the low-profile logging sensor suspension system 400 (see FIG. 4). The exemplary embodiment cross-section 500 includes a sensor assembly 502, a plurality of vibration isolators 504 in isolator channels 516, a shrinkable thin-walled tube 506, a retainer 508, a wiring harness 510 in a wire well 512 and an active element 514 of the sensor assembly 502. It should be noted that in this exemplary embodiment, vibration isolators 504 is illustrated in cross-section 500 as 504*a* and 504*b*, showing that vibration isolators 504 is a one-piece oval in shape. In one aspect of the exemplary embodiment, the retainer 508 acts to restrain the vibration isolators 504 in their selected positions. For example, the selected positions can be in isolator channels 516 made for the shape of the vibration isolators 504 and the retainer 508 can be cellophane tape wrapped around the vibration isolators 504 and the sensor assembly 502.

In another aspect of the exemplary embodiment, isolator channels 516 that can retain the oval vibration isolators 504 can be made in the outer surface of the sensor assembly 502. It should be noted in this exemplary embodiment, the oval vibration isolators 504 can be attached to the outer surface of the sensor assembly without making isolator channels 516 in the outer surface of the sensor assembly 502. In a further non-limiting exemplary embodiment, the oval shaped vibration isolators 504 can be attached to the inner surface of the shrinkable thin-walled tube 506. It should also be noted in this exemplary embodiment that the vibration isolators 504 are not limited to cylindrical strips or ovals but can be any other shape acceptable for vibration reduction.

Figure 6:
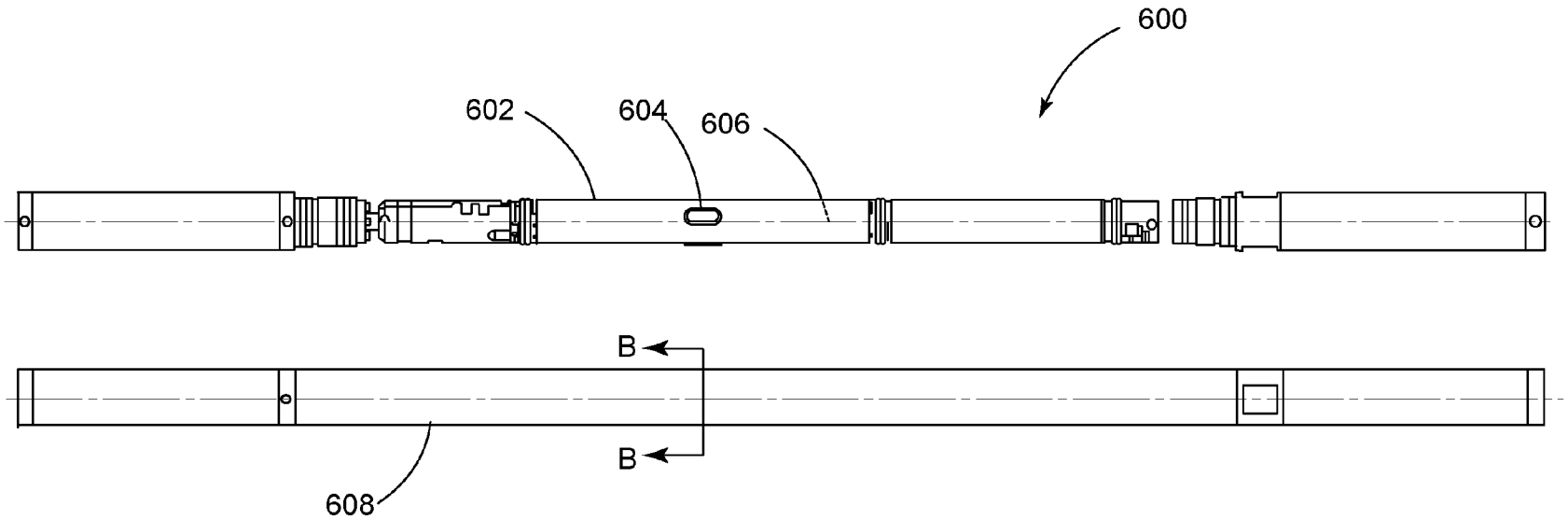
FIG. 6 depicts a sensor low-profile suspension system with a racetrack isolator arrangement and the sensor low-profile suspension system with a racetrack isolator arrangement encased in a pressure housing.

Turning now to FIG. 6, a detailed diagram of an exemplary embodiment of a low-profile logging sensor suspension system 600 is presented. The exemplary embodiment includes a sensor assembly 606, a shrinkable thin-walled tube 602, a plurality of vibration isolators 604 placed around a circumferential location of a sensor assembly 606 and a pressure housing 608. It should be noted in this exemplary embodiment that the sensor assembly 606 and the vibration isolators 604 are encased in a shrinkable thin-walled tube 602 and the shrinkable thin-walled tube is already constricted.

Continuing with the exemplary embodiment, the sensor assembly 606, encased with the vibration isolators 604 by the shrinkable thin-walled tube 602, can be inserted into a pressure housing 608 which can be part of down-hole well drill. Further, in this exemplary embodiment, after insertion into the pressure housing 608, the vibration isolators 604 are compressed and exert a symmetrical force on the shrinkable sensor assembly 606, holding the sensor assembly 606 centered in the pressure housing 608 and isolated from the pressure housing 608 vibrations. In another aspect of the exemplary embodiment, the vibration isolators 604 can be placed at locations capable of preventing unacceptably low resonant frequencies, therefore eliminating vibration induced false counts and preventing damage to the active element of the sensor assembly 606.

Figure 7:
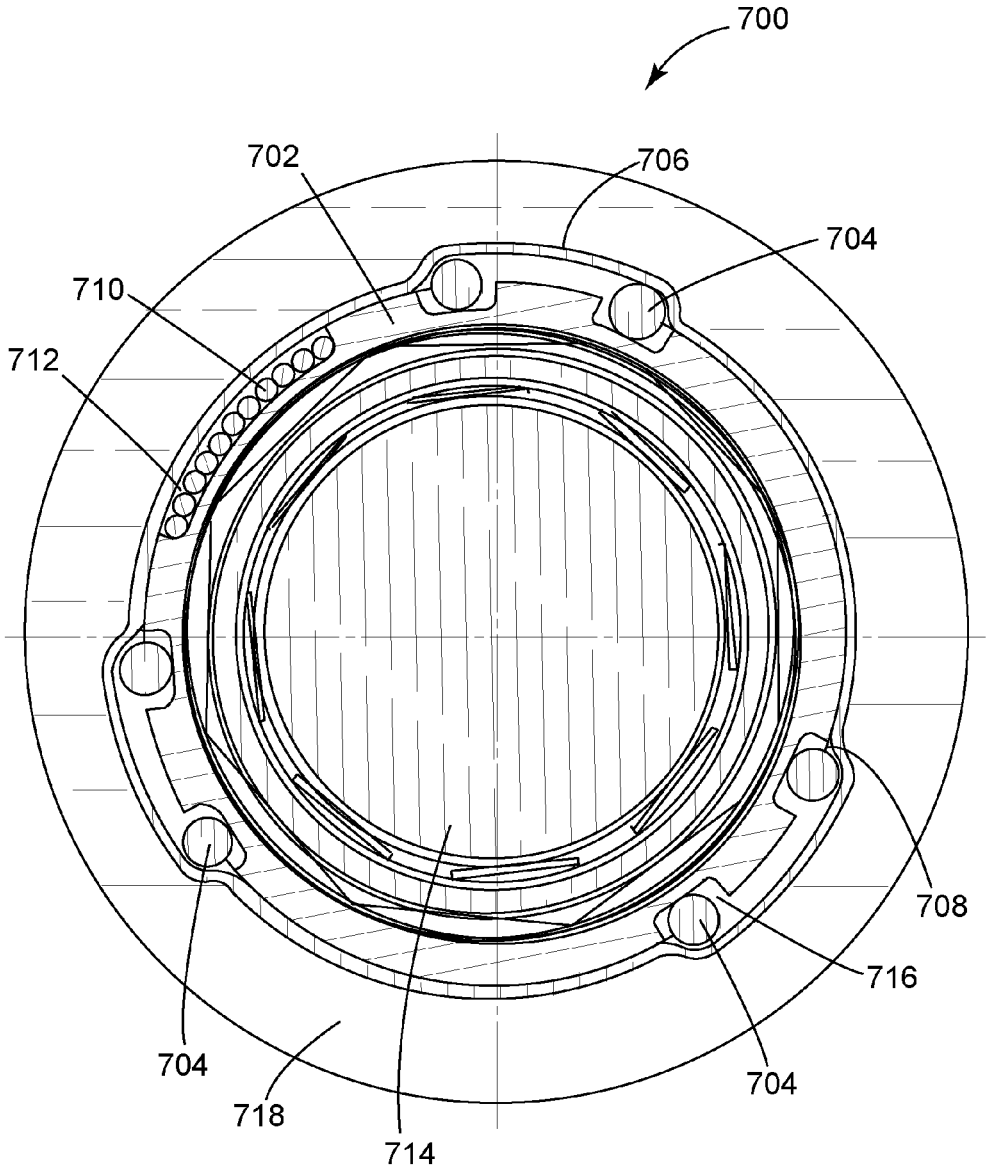
FIG. 7 depicts an enlarged cross-section view of a sensor low-profile suspension system with a racetrack isolator arrangement encased in a pressure housing.

Looking now to FIG. 7, an exemplary embodiment of a cross-section 700 of a low-profile logging sensor suspension system 700 inserted in a pressure housing 718 is depicted. The exemplary cross-section 700 is shown from position B-B on the low-profile logging sensor suspension system 600 of FIG. 6. The exemplary embodiment cross-section 700 includes a sensor assembly 702, a plurality of oval vibration isolators 704 in isolator channels 716, a shrinkable thin-walled tube 706, a retainer 708, a wiring harness 710 in a wire well 712 and an active element 714 of the sensor assembly 702.

Continuing with the exemplary embodiment, the sensor assembly 702 and the oval vibration isolators 704, encased by the shrinkable thin-walled tube 706 are inserted in the pressure housing 718. In another aspect of the exemplary embodiment, the oval vibration sensors 704 are under compression by the inner surface of the pressure housing 718 and have centered the sensor assembly 702 in the pressure housing 718. In a further aspect of the exemplary embodiment, vibrations generated by the drilling operations and transferred to the pressure housing 718 are dampened by the vibration isolators 704 before reaching the sensor assembly 702 and the active element enclosed inside the sensor assembly 702.

In another aspect of the exemplary embodiment, the shrinkable thin-walled tube 706 allows for a larger cross-section of vibration isolators 704 to be installed in the shallow isolator channels 716 than would be possible without the shrinkable thin-walled tube 706. In a further aspect of the exemplary embodiment, the protrusion of the vibration isolators 704 and the shrinkable thin-walled tube 706 from the sensor assembly 702 contact the inside surface of the pressure housing 718 and the supporting force of the vibration isolators 704 limits the exposure of the sensor assembly 702 to transverse vibration, prevents impingement of the sensor assembly 702 on the inner surface of the pressure housing 718 and produces a frictional force that dampens axial motion of the sensor assembly 702 in the pressure housing 718.

Continuing with another aspect of the exemplary embodiment, the vibration isolators 704 and the shrinkable thin-walled tube 706 are replaceable as required during existing field inspection and service. Further, the exemplary embodiment vibration isolators 704 can be constructed of different materials and to different dimensional specifications to tune the frequency response of the suspended sensor assembly 702 based on operational vibration characteristics and operational temperatures.

Figure 8:
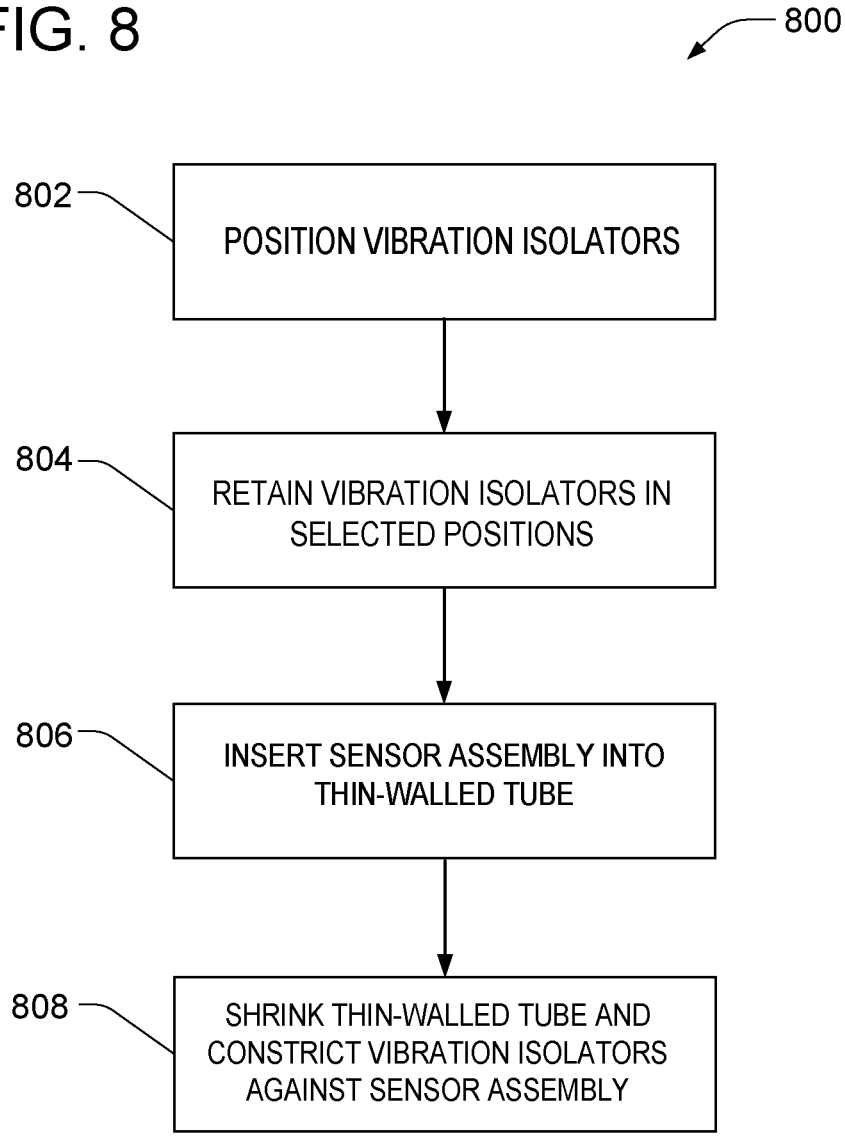
FIG. 8 is a flowchart depicting a method for reducing the operational vibration of a well down-hole sensor encased in a pressure housing shell.

Continuing now to FIG. 8, an exemplary method embodiment 800 for positioning and retaining a plurality of vibration isolators 204 between a sensor assembly 202 and a shrinkable thin-walled tube 206 encasing the plurality of vibration isolators 204 and the sensor assembly 202 is depicted. Starting at exemplary method embodiment step 802, the vibration isolators 204 are positioned around the outer surface of the sensor assembly 202. In this exemplary method embodiment, the vibration isolators can be cylindrical strips placed in isolator wells 216 cut into the outside surface of the sensor assembly 202. In another exemplary method embodiment, the vibration isolators 204 can be placed on the outer surface of the sensor assembly. In a further exemplary method embodiment, the vibration isolators 204 can be oval in shape and placed either in oval shaped isolator wells 516 cut into the outer surface of the sensor assembly 502 or on the outer surface of the sensor assembly 502. Continuing with another exemplary method embodiment, the vibration isolators can be positioned around the inner surface of the shrinkable thin-walled tube 206.

Next at exemplary method embodiment step 804, the vibration isolators 204 can be retained in the selected positions. In one exemplary method embodiment, the vibration isolators can be retained with cellophane tape wrapped around the vibration isolators and the sensor assembly 202 as depicted in exemplary embodiment 300. In another exemplary method embodiment, the vibration isolators 204 can be retained by applying an epoxy resin between each vibration isolator 204 and the sensor assembly 202. In another exemplary method embodiment, an elastic band can be stretched around the vibration isolators 204 and the sensor assembly 202 or the vibration isolators 204 can be inserted into pockets in the elastic band and the elastic band can be stretched around the sensor assembly. In another exemplary method embodiment, the vibration isolators can be attached to the inner surface of the shrinkable thin-walled tube 206.

Next at exemplary method embodiment step 806, the sensor assembly 202, with the positioned and attached vibration isolators 204, can be inserted into the shrinkable thin-walled tube 206. In this exemplary method embodiment, the shrinkable thin-walled tube 206 can be initially of inner diameter larger than the outer diameter of the sensor assembly 202 and attached vibration isolators 204 to allow easy insertion without disturbing the positions of the vibration isolators 204. In another exemplary method embodiment, the sensor assembly 202 can be inserted in the shrinkable thin-walled tube 206, with the vibration isolators 204 attached to the inner surface of the shrinkable thin-walled tube 206.

Next at exemplary method embodiment step 808, the shrinkable thin-walled tube 206 can be constricted around the sensor assembly 202 and the vibration isolators 204 compressing the vibration isolators 204 against the outer surface of the sensor assembly 202. In one exemplary method embodiment, the shrinkable thin-walled tube 206 can be constricted by heating the shrinkable thin-walled tube 206. In another exemplary method embodiment, the shrinkable thin-walled tube 206 can be constricted by exposure to appropriate chemicals or vapors based on the material used to manufacture the shrinkable thin-walled tube 206.

The disclosed exemplary embodiments provide a system and a method for dampening vibrations experienced by a down-hole well sensor assembly during drilling operations. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A low-profile well sensor suspension system, the system comprising:

a plurality of vibration isolators configured to dampen vibrations of a sensor assembly during well drilling operations;

a shrinkable thin-walled tube configured to encase said plurality of vibration isolators and said sensor assembly; and a retainer configured to attach said plurality of vibration isolators to circumferential locations around an outer surface of said sensor assembly or an inner surface of said shrinkable thin-walled tube.

2. The system of claim 1, wherein said locations are equally spaced around said outer surface of said sensor assembly.

3. The system of claim 1, wherein said locations around said sensor assembly have channels fitting a shape of said plurality of vibration isolators.

4. The system of claim 1, wherein a second plurality of vibration isolators is attached to a second circumferential location around said outer surface of said sensor assembly or said inner surface of said shrinkable thin-walled tube.

5. The system of claim 1, wherein said plurality of vibration isolators are cylindrically dimensioned strips.

6. The system of claim 1, wherein said plurality of vibration isolators are cylindrically dimensioned ovals.

7. The system of claim 1, wherein said retainer is a cellophane tape.

8. The system of claim 1, wherein said retainer is an epoxy resin.

9. The system of claim 1, wherein said plurality of vibration isolators are constructed of a fluoroelastomer.

10. The system of claim 1, wherein said shrinkable thin-walled tube is constructed of polytetrafluoroethylene.

11. The system of claim 1, wherein said shrinkable thin-walled tube is constructed of an aromatic polyamide.

12. A method for positioning and retaining a plurality of vibration isolators between a sensor assembly and a shrinkable thin-walled tube encasing said plurality of vibration isolators and said sensor assembly, the method comprising:

positioning said plurality of vibration isolators around a circumference of an outer surface of said sensor assembly;

retaining said plurality of vibration isolators against said sensor assembly;

inserting said sensor assembly into said shrinkable thin-walled tube; and shrinking said shrinkable thin-walled tube until said shrinkable thin-walled tube constricts on said sensor assembly.

13. The method of claim 12, wherein positioning said plurality of vibration isolators further comprises placing said plurality of vibration sensors in shallow grooves in said outer surface of said sensor assembly.

14. The method of claim 12, wherein retaining said plurality of vibration isolators further comprises wrapping a cellophane tape around said plurality of vibration sensors and said sensor assembly.

15. The method of claim 12, wherein retaining said plurality of vibration isolators further comprises securing an elastic band around said plurality of vibration isolators and said sensor assembly.

16. The method of claim 12, wherein shrinking said shrinkable thin-walled tube further comprises heating said shrinkable thin-walled tube encasing said sensor assembly until said shrinkable thin-walled tube constricts said plurality of vibration sensors to said sensor assembly.

17. A down-hole well sensor instrumentation vibration dampening and protection system, the system comprising:

a cylindrically-shaped sensor assembly configured to include a gamma radiation sensor and to include plural channels on an outside surface;

a plurality of cylindrically-shaped vibration isolators configured to dampen vibrations of the sensor assembly during well drilling operations, wherein the plural channels are configured to fit said plurality of cylindrically-shaped vibration isolators;

a retainer configured to attach said plurality of cylindrically-shaped vibration isolators in said plurality of channels;

a shrinkable thin-walled tube configured to encase said plurality of cylindrically-shaped vibration isolators, said retainer and said sensor assembly; and a pressure housing configured to compress said plurality of cylindrically-shaped vibration isolators against said sensor assembly.

18. The system of claim 17, wherein a wiring harness is encased in a wire channel made in said sensor assembly, in an axial direction, and protected by said shrinkable thin-walled tube.

19. The system of claim 17, wherein a radius from the center of said sensor assembly and passing through a constricted cylindrically-shaped vibration isolator is greater that a radius from the center of said sensor assembly and not passing through a constricted cylindrically-shaped vibration isolator.

20. The system of claim 17, wherein said cylindrically-shaped vibration isolators and said shrinkable thin-walled tube are configured to be replaced during periodic field inspection and service.

* * * * *